United States Patent [19]

Groth

[11] 4,048,599

[45] Sept. 13, 1977

[54] ELECTRIC SWITCHING DEVICE

[75] Inventor: Otto Groth, Tailfingen, Germany

[73] Assignee: Elektra Tailfingen Ammann & Cie, Tailfingen, Germany

[21] Appl. No.: 684,490

[22] Filed: May 10, 1976

Related U.S. Application Data

[63] Continuation of Ser. No. 568,028, April 14, 1975.

[30] Foreign Application Priority Data

Apr. 19, 1974 Germany ..... 2419038

[51] Int. Cl.[2] ..... H01H 83/00

[52] U.S. Cl. ..... 335/20; 335/155

[58] Field of Search ..... 335/20, 19, 155; 361/92

[56] References Cited

U.S. PATENT DOCUMENTS

| | | | |
|---|---|---|---|
| 3,264,428 | 8/1966 | Hollyday | 335/20 X |
| 3,559,125 | 1/1971 | Ellis | 335/20 |
| 3,675,177 | 7/1972 | Ellenberger | 335/19 X |
| 3,723,924 | 3/1973 | Shaffer et al. | 335/20 X |

FOREIGN PATENT DOCUMENTS

| | | | |
|---|---|---|---|
| 721,862 | 6/1942 | Germany | 335/20 |

*Primary Examiner*—George Harris

*Attorney, Agent, or Firm*—Kenway & Jenney

[57] ABSTRACT

An electric switching device has a selector shaft that drives a switching element between a "cut-out" position in which the switch is open and a "cut-in" position in which the switch is closed. In the cut-in position, a set of "movable" electric contacts carried on the switching element each make electrical connection with a corresponding "fixed" contact supported on a housing. A cut-out mechanism automatically opens the switch when the voltage across the switch falls below a predetermined value (an undervoltage condition). The cut-out mechanism includes an electromagnet, wired in series with the switch, which controls the movement of the blocking lever. The blocking lever is movable between a blocking position in which it holds the switching element in its cut-in position, and a release position in which it allows the switching element to move to its cut-out position. A control element and a release lever provide an operative connection between the electromagnet and the blocking lever such that the blocking lever moves from its blocking position to its release position in response to an undervoltage condition. In addition, the switch will not automatically reclose when the voltage rises above the predetermined value, and if manually reclosed during an undervoltage condition, the switch will not remain closed.

13 Claims, 13 Drawing Figures

ELECTRIC SWITCHING DEVICE

This is a continuation, of application Ser. No. 568,028, filed Apr. 14, 1975.

BACKGROUND OF THE INVENTION

This invention relates in general to electric switches and more specifically to switches that automatically open when the voltage across the switch drops below a predetermined level (an undervoltage condition). Switches of this type are commonly used as protective motor switches, that is, the switch prevents the operation of the motor unless the voltage applied to the motor is at or above a minimum operating level. Such switching devices are also useful when it is desired to prevent the uncontrolled start of machinery following a diminution or failure of electric power to the machinery. Heretofore such switching devices have commonly employed a bi-metallic element or a short circuit protection system to control a lock system that acts on a movable switching element to open the switch during an undervoltage condition. Such designs, however, have a complex construction, have elements which are difficult to fabricate, and are expensive to manufacture.

It is therefore a principal object of this invention to provide an electric switching device that has a reliable, relatively simple, and low cost undervoltage cut-out mechanism.

SUMMARY OF THE INVENTION

A switching device has a housing that supports a set of fixed electric contacts and a switching element that carries a set of movable electric contacts. The switching element is movable between a cut-out position in which the switch is open, and a cut-in position in which the switch is closed and each of the movable contacts is in electrical connection with a corresponding fixed contact. In the preferred forms, the switching element moves linearly along its longitudinal axis and is biased towards its cut-out position. A selector shaft, which is preferably connected to the switching element through a toggle lever arrangement, drives the switching element to either its cut-in or cut-out position.

A cut-out mechanism, which automatically opens the switch when the voltage across the switch falls below a predetermined value (an undervoltage condition), includes an electromagnetic control means, a release lever and a blocking lever assembly. The electromagnetic control means had an electromagnet acting as a component of a solenoid that actuates a control element. The control element in turn actuates the release lever when the voltage across the switch, and the electromagnet wired in series with the switch, falls below the predetermined level. When thus actuated, the release lever moves the blocking mechanism from a blocking position where it holds the switching element in its cut-in position, to a release position where it allows the switching element to move to its cut-out position. In the preferred forms the electromagnet is opposed by a spring selected to achieve the desired actuating movement during an undervoltage condition. The blocking lever may be a bi-stable toggle lever arrangement and the release lever and blocking lever are preferably spring loaded to balance the force of the switching element bias and to reliably drive the switch components between their switch open and switch closed positions with a minimum of applied force.

These and other features and objects of the invention will be more fully understood from the following detailed description of the invention to be read in conjunction with the accompanying drawings.

DETAILED DESCRIPTION OF THE PREFERRED EMBODIMENTS

FIGS. 1–7 illustrate a preferred embodiment of a switching device constructed according to the invention that controls an electric current in a circuit connected across the switch and has a capability of automatically opening the switch when the voltage across it falls below a predetermined cut-out level (an undervoltage condition). For the purposes of this description, when the voltage across the switch is at or above the predetermined cut-out level, the voltage will be referred to as at a "normal" or "operating" level.

Figure 1:
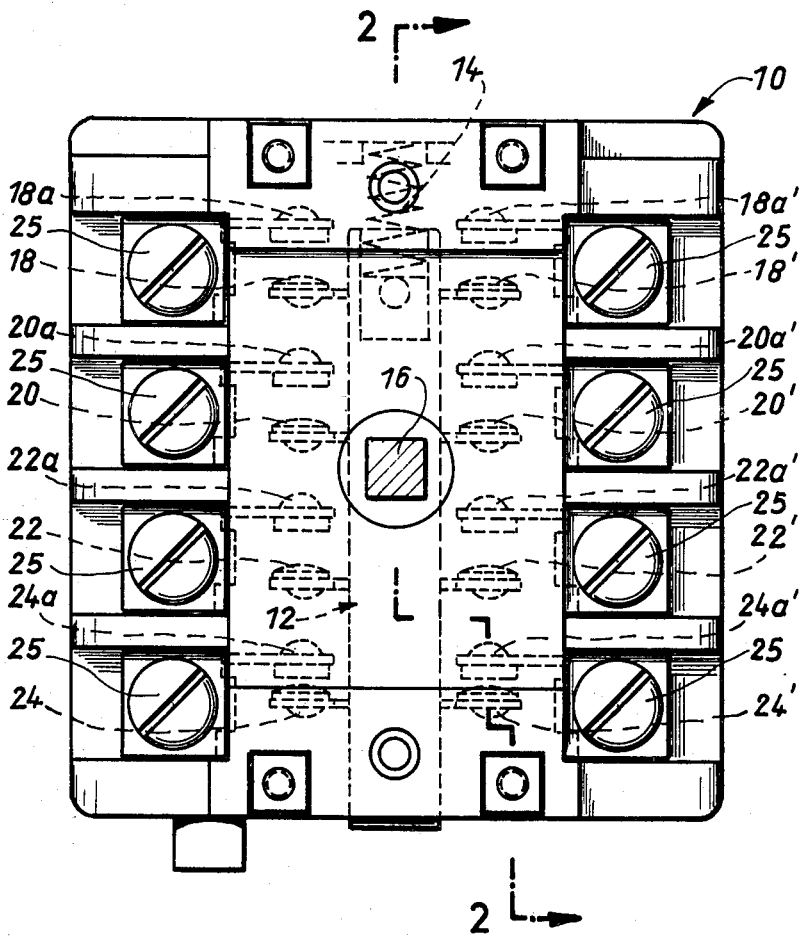
FIG. 1 is a view in front elevation of one embodiment of a switching device constructed according to the invention.
Figure 2:
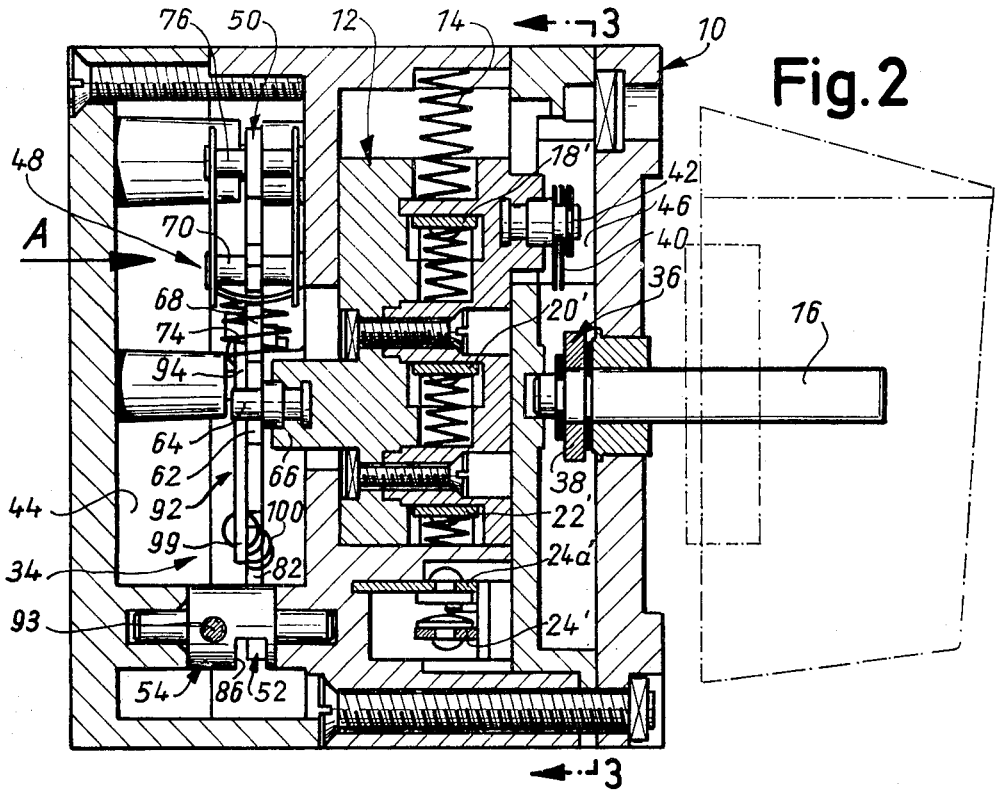
FIG. 2 is a view in vertical section taken along the line 2—2 of FIG. 1.
Figure 4:
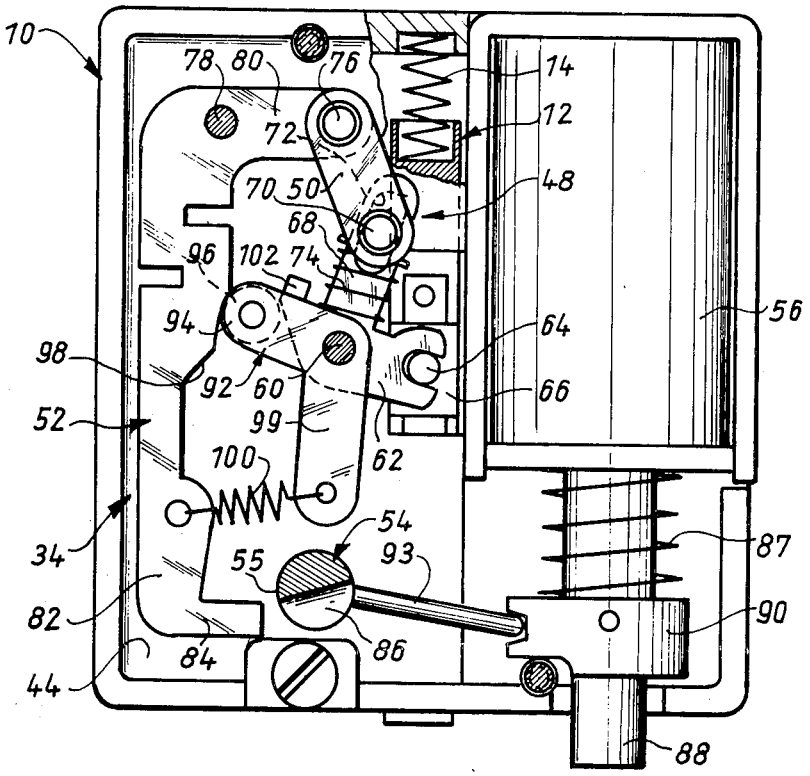
FIG. 4 is a view in left side elevation of the switch shown in FIG. 2 with the housing removed and the switch in the open condition.
Figure 5:
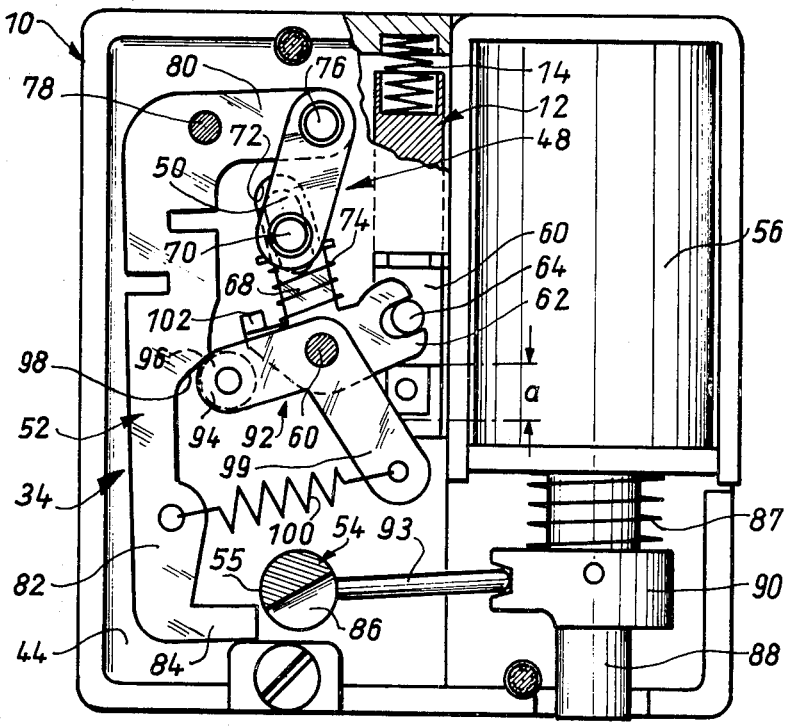
FIG. 5 is a view corresponding to FIG. 4 showing the switch in the closed condition with the voltage across the switch at the normal operating level.
Figure 6:
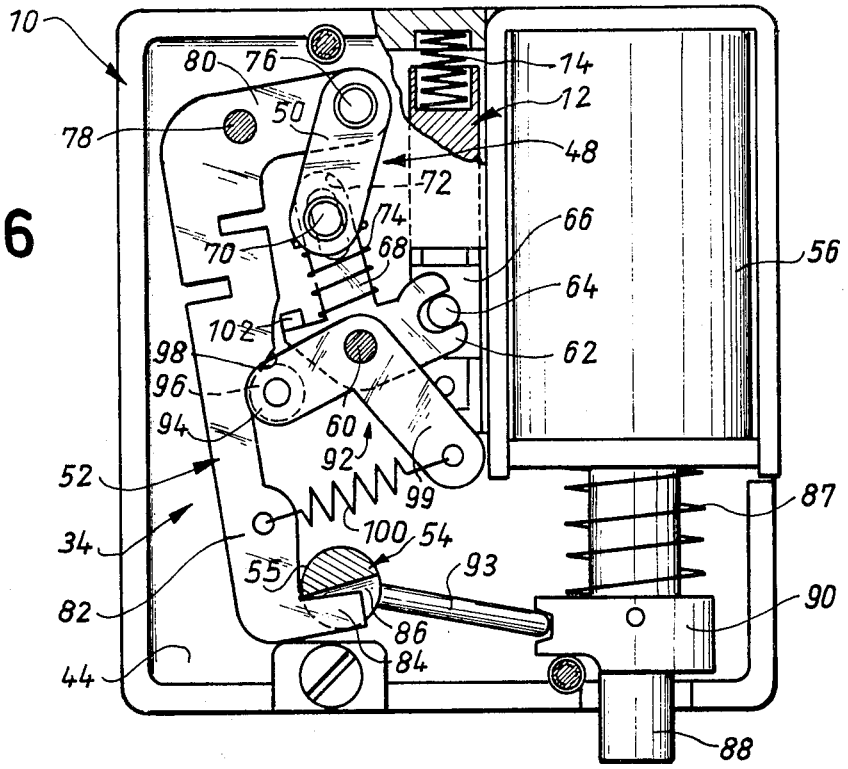
FIG. 6 is a view corresponding to FIGS. 4 and 5 showing the switch in the closed condition but with the voltage having just fallen below the predetermined level.
Figure 7:
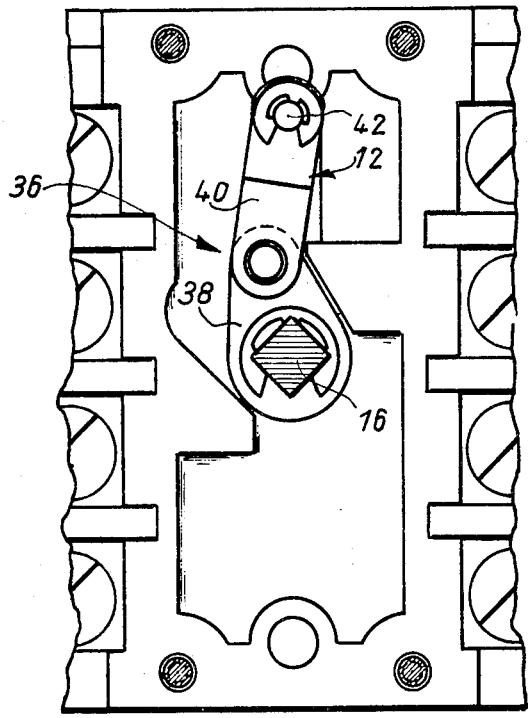
FIG. 7 is a view corresponding to FIG. 3 with the switch in the closed condition.

The switching device has a housing indicated generally at 10 which supports and guides a switching element 12 movable in a linear direction along its longitudinal axis between a cut-out position (FIGS. 2–4) and a cut-in position (FIGS. 5–7). The switching element 12 carries a set of "movable" electrical contact pairs 18 and 18', 20 and 20', and 22 and 22', as well as a pair of contacts 24 and 24' that make a series connection with the switch. When the switching element is in its cut-in position, each of these contacts makes an electrical connection with a corresponding fixed contact mounted on the housing 10 and designated as 18*a* and 18*a'*, 20*a* and 20*a'*, 22*a* and 22*a'*, and 24*a* and 24*a'*, respectively. FIG. 1 illustrates the relationship between the contacts when the switch is in its open condition and the switching element 12 is in its cut-out position. Each fixed contact is in electrical connection with an associated terminal screw 25 accessible from the exterior of the housing 10.

A cut-out mechanism, indicated generally at 34, actuates the movement of the switching element from its cut-in position to its cut-out position in response to an undervoltage condition. The cut-out mechanism 34 translates this undervoltage condition into a mechanical movement that releases a blocking lever assembly of the cut-out mechanism thereby allowing the switching element to move under the influence of a counterspring 14 into its cut-out position. When the voltage is at its normal operating lever, the blocking lever assembly maintains the switching element in the cut-in position against the action of the spring 14. Further, the cut-out mechanism 34 assures that the switching element 12 can be manually placed in its cut-in position through a rotation of a selector shaft 16, to close the switch when the voltage again attains its normal operating level. It should be noted that the cut-out mechanism also allows the switch to be manually opened, through an opposite rotation of the selector shaft 16, while the voltage is at the operating level.

Figure 3:
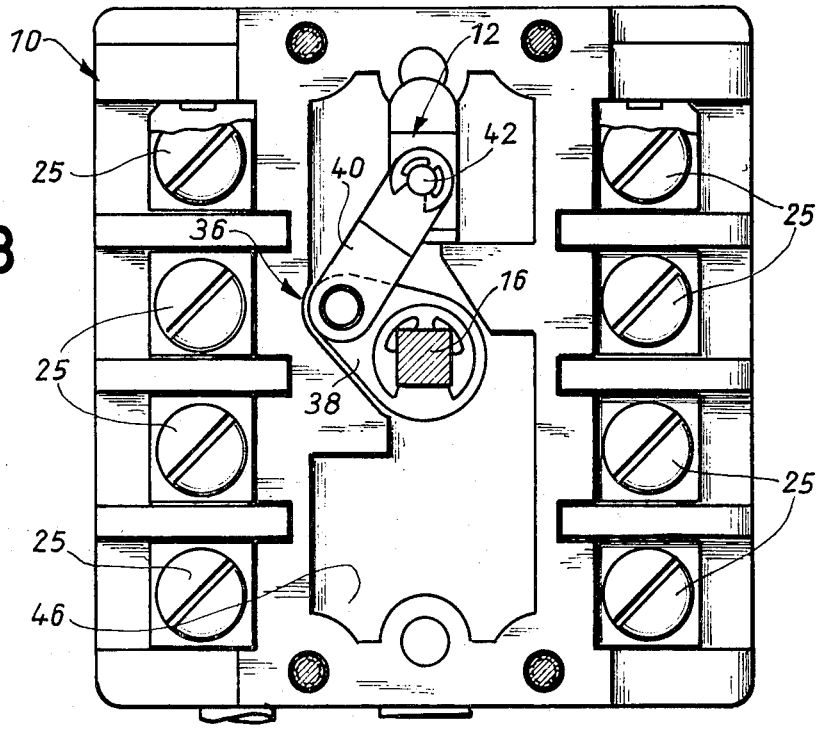
FIG. 3 is a view corresponding to FIG. 1 with portions of the housing removed to show the operative connection between the selector shaft and the switching element.

With reference to FIG. 3, a first toggle lever 36 links the selector shaft 16 and the switching element 12. The toggle lever 36 has one lever leg 38 that is non-rotatably mounted on the selector shaft 16 and another lever leg 40 that is pivotally mounted on an assembling pin 42 formed on the switching element 12. Through a rotation of the selector shaft 16, the switch can be manually opened and closed since the toggle lever 36 provides a direct, positive connection such that a suitable rotation of the selector shaft 16 carries the switching element between its cut-out and cut-in positions.

A principal feature of the invention is the cut-out mechanism 34 which can be best seen in FIGS. 2 and 4–6. The mechanism 34 is located in a housing compartment 44 that lies opposite a housing compartment 46 that accomodates the first toggle lever 36. The switching element 12 lies between the compartments 44 and 46. The cut-out mechanism has a blocking lever assembly, indicated generally at 48, which is formed by a second toggle lever. The movement of one leg 50 of the second toggle lever 48 is controlled by an electromagnet 56 acting through a control element 54 and a release lever 52. The other lever leg of the second toggle lever 48 is an angle lever pivotably about a fixed pivot axis 60. One arm 62 of this angle lever leg is formed at one end in the shape of a fork that engages a tang 64 formed on an extension piece 66 of the switching element 12. The tang 64 projects into the housing compartment 44. The lever leg 50 is articulated about a pivot pin 70 which rides in an elongated closed slot 72 formed in the arm 68 of the angle lever. A compression spring 74 urges the pivot pin 70 to move in the slot 72 towards the free end of the lever arm 68. The lever leg 50 is also pivoted at its other end about a pivot pin 76 formed on the release lever 52.

The blocking or second toggle lever 48 is movable through a dead center position (in which the toggle legs are in alignment) between two stable positions illustrated in FIGS. 4 and 5. With the switch open, as illustrated in FIG. 4, a manual rotation of the selector switch that carries the switching element into its cut-in position also causes the blocking lever 48 to move from the position shown in FIG. 4 to the position shown in FIG. 5. After the blocking lever passes through its dead center position, the compression spring 74 genertes a turning moment that drives a angle lever counter-clockwise about the pivot axis 60 to a position where it maintains or locks the switching element 12 in its cut-in position (FIG. 5).

The release lever 52 is pivotable about a fixed pin 78 with arms 80 and 82 of the release lever 52 lying on opposite sides of the pin 78. The lever arm 82 is preferably significantly longer than arm 80. The arm 80 is pivotally linked to the lever leg 50 of the blocking lever 48 at the pivot pin 76; the arm 82 interacts with the control element 54. A key finger 84, extending generally in the direction of the control element 54, is formed at the free end of the lever arm 82.

The control element 54 is preferbly a cylindrical member located generally below the blocking lever 48, as shown, and pivotable about a point in substantially vertical alignment with the pivot axis 60. A slot 86 formed on the control element extends along a diameter of the element in a direction substantially transverse to the longitudinal axis of the control element. When the control element 54 has the angular orientation shown in FIG. 5, the key finger 84 is blocked against a counter-clockwise movement from the position shown in FIG. 4 by an eccentric control surface 55. When the control element 54 is in the angular position shown in FIG. 6, the key finger 84 is able to penetrate into the slot 86 thereby allowing the release lever 52 to rotate a significant angular distance, in a counter-clockwise direction, about the pivot pin 78. The angular position of the control element 54 is controlled by the electromagnet 56 acting through a core or armature 88 (that together with the electromagnet forms a solenoid), a catch 90 secured on the core 88, and a lever 93 secured at one end to the control element 54 and carried at its other end in the catch 90.

A delay mechanism, indicated generally at 92, delays the counter-clockwise movement of the release lever 52 from the position shown in FIG. 4 to the position shown in FIG. 5 or FIG. 6 as the switch moves from its open to closed positions. This delay gives the switching element 12 time to move towards its cut-in position a sufficient distance to close the series contacts 24, 24', 24*a* and 24*a'* thereby energizing the electromagnet 56. The device 92 has an angled lever pivoted on the stationary pivot axis 60 of the blocking lever 48. One leg 94 of the lever carries a roller 96 at its free end which engages a curved edge surface 98 formed on the release lever arm 82. The other leg 99 of the angled lever is connected to the lever arm by a spring 100 that urges the leg 94 into contact with a stop 102 formed on the blocking lever arm 62.

In operation, beginning with the switch in the open position shown in FIGS. 1–4, a rotation of the selector shaft 16 drives the switching element 12 from its cut-out position to its cut-in position through the action of the first toggle lever 36. This rotation continues against the action of the counter spring 14 until the switching element moves in an upward direction (as shown) a distance a (FIG. 5). This places the movable contact pairs in electrical connection with the corresponding fixed contact pairs which closes the switch. If the voltage across the switch is at the normal operating level, the electromagnetic force enerated by the electromagnet 56 is sufficient to draw the core or armature against the force of a resetting spring 87, to the position shown in FIG. 5. In this position the eccentric surface 55 is in position to block the counter-clockwise movement of the release lever 52.

When the switching element 12 moves to its cut-in position, the first toggle lever 36 moves towards the position shown in FIG. 7, near its dead center point. At the same time the blocking lever 48 moves from the release position shown in FIG. 4 into the blocking position shown in FIG. 5. This movement of the blocking lever 48 influences the release lever 52 in the following manner. First, the leg 50 urges the release lever 52 in a counter-clockwise direction about its swivel axis 78. Second, the stop 102 acutates the delay mechanism 92 to ensure that the release lever 52 will pivot only after the series contacts 24, 24', **24*a* and 24*a'* have been closed. When the delay mechanism allows the release lever 52 to pivot, it moves through a relatively small angle until the key finger 84 strikes the surface 55. This small pivotal movement does not result in any substantial movement of the pivot axis 76. This is significant since the spring 74 therefore remains compressed and continues to urge the lever arm 52 in a counter-clockwise direction with sufficient force to prevent the counter spring 14** from driving the switching element and the blocking lever back into their open switch positions. The switching element is thus blocked or locked in the cut-in position.

In contrast, if there is an undervoltage condition when the switch is set to the closed position, or if an undervoltage condition should occur while the switch is locked in its closed position, the resetting spring 87 becomes the dominant force acting on the core 88 and drives it to the position shown in FIG. 6. This movement of the core rotates the control element 54 in a clockwise direction until the key finger 84 penetrates the slot 86 under the influence of the spring 74. The angular travel of the arm release lever 52 associated with this penetrating movement substantially dissipates the force generated by the spring 74 to a point that counter spring 14 becomes dominant and drives the switching element 12 to its cut-out position. This movement of the switching element also returns the blocking lever and other members to the position shown in FIG. 4. Thus, the cut-off mechanism 34 acts as a locking system for the switching device. With a normal operating voltage, the mechanism 34 locks or blocks the switch in its cut-in or closed position. In the event of an undervoltage condition, the mechanism 34 automatically opens the switch. If the voltage then returns to its normal operating level, the switch will remain open until it is manually closed through a rotation of the selector shaft 16. Further, if the switch is manually closed during an undervoltage condition, it will automatically return to its open position.

It is significant that the first toggle lever 36 is not in its dead center position when the switch is closed since such a condition could lock the switching element in its cut-in position and make the cut-out mechanism 34 ineffective. However, since the toggle legs 38 and 40 are nearly aligned, they do off-set to some extent the force of the counter spring 14 so that in manually opening the switch it is only necessary to overcome a relatively small net force generated by the opposed springs 14 and 74. In addition, it is possible to utilize relatively low force levels to automatically open the switch through a proper selection of the ratio of the lengths of the arms 80 and 82 and the characteristics of the compression spring 74. This low release force, which may be in the range of 100 to 150 grams, can be generated by a low cost miniature magnet 56 and a relatively weak resetting spring 87.

The operating advantages described above are also characteristic of the alternative preferred embodiment of the invention illustrated in FIGS. 8–10 and FIGS. 11–13. Although these Figures and the following description focus on the automatic cut-out mechanism or locking system of the switching device, it will be understood that the cut-out mechanism is utilized in a switching device such as that described with reference to the embodiment shown in FIGS. 1–7.

Figure 8:
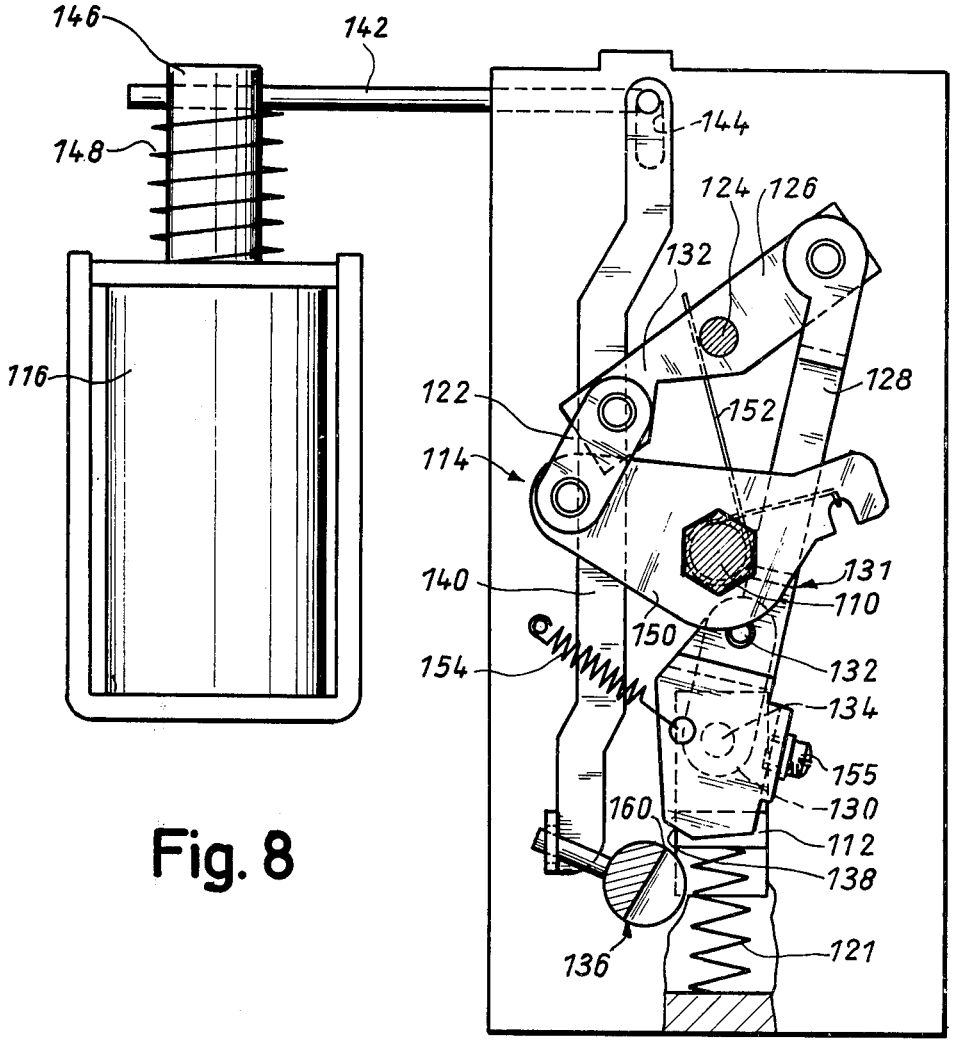
FIG. 8 is a view corresponding to FIGS. 4–6 of an alternative embodiment of an undervoltage cut-off mechanism constructed according to the invention with the switch in an open condition.
Figure 9:
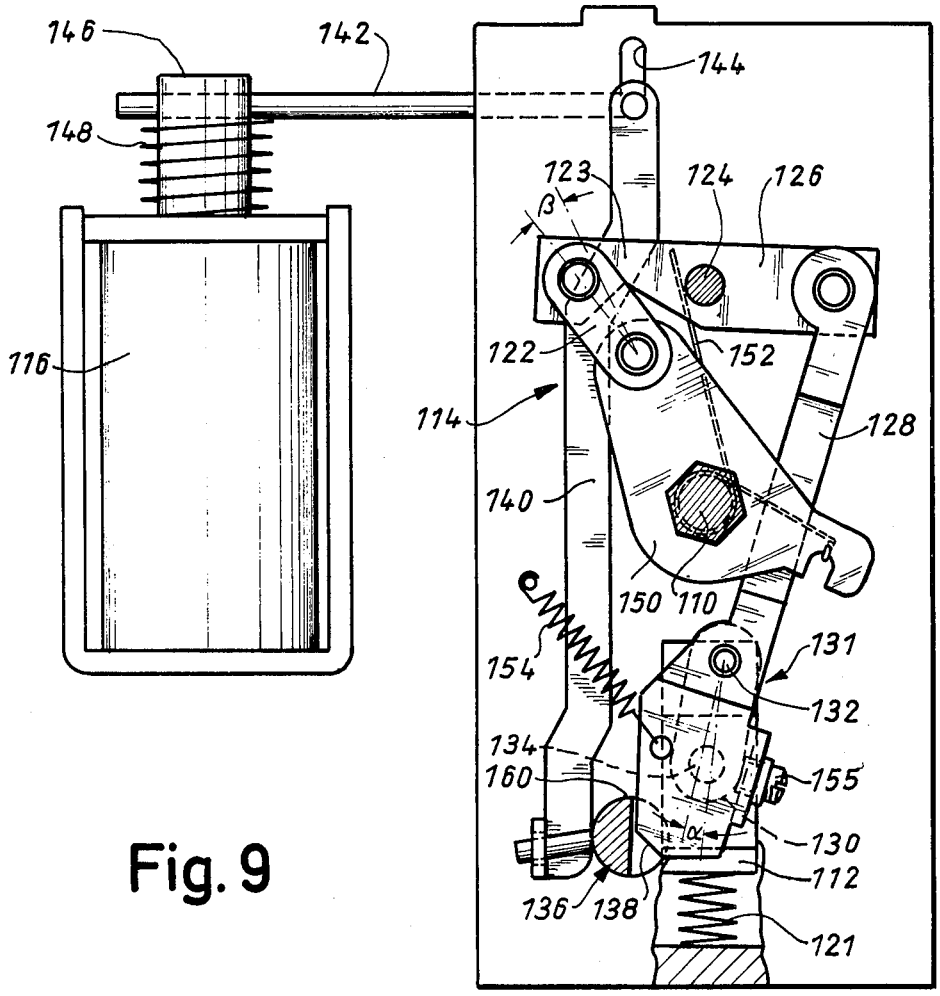
FIG. 9 is a view corresponding to FIG. 8 showing the switch in a closed condition with the voltage across the switch at the normal operating level.
Figure 10:
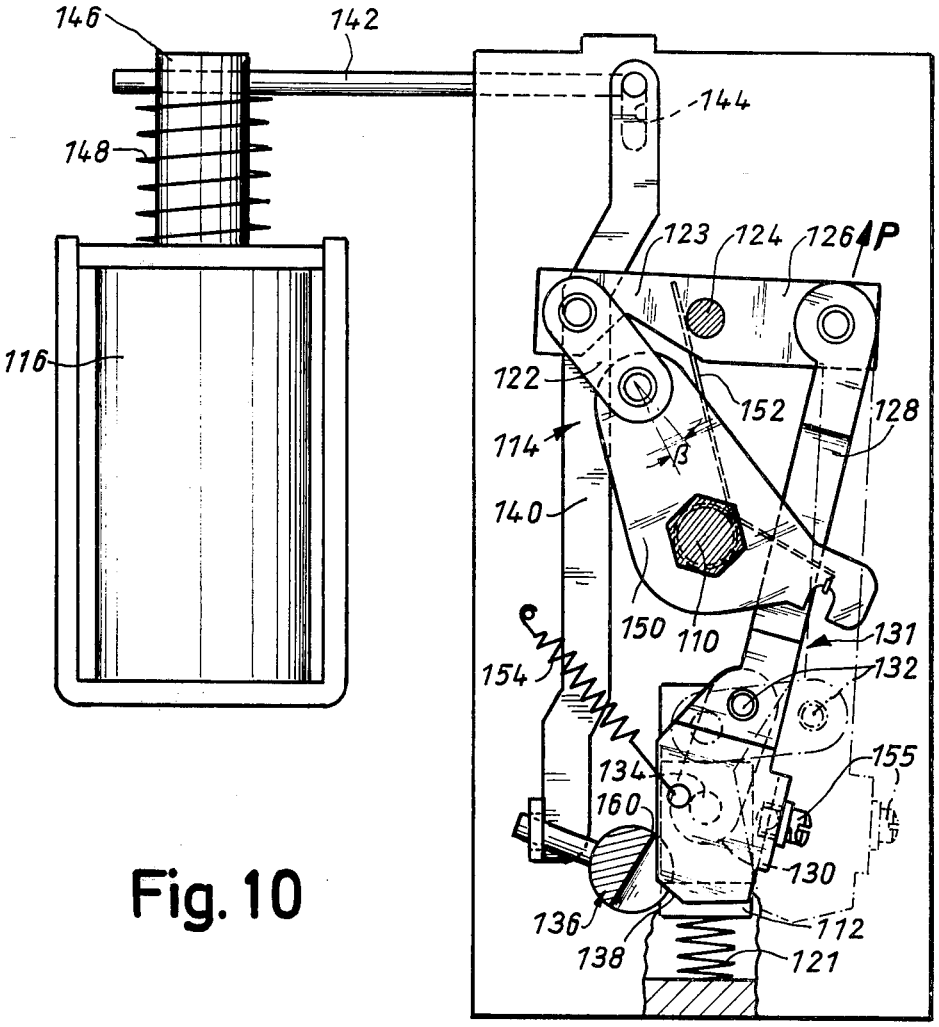
FIG. 10 is a view corresponding to FIGS. 8 and 9 showing the switch in the closed position, but about to open due to an undervoltage condition.

With reference to the embodiment shown in FIGS. 8–10, the cut-out mechanism operates in conjunction with a first toggle lever 114 that operatively connects a selector shaft 116 and a switching element 112, both of which are located in a common housing space. An electromagnet 116 is typically located in a separate compartment. The first toggle lever 114 has a lever leg 150 non-rotatably mounted on the selector shaft 110 and another lever leg 122 pivotally connected at one of its ends to the free end of the leg 150 and pivotally connected at its other end to an arm 123 of a double armed lever that rotates about a stationary pivot axis 124. The other arm 126 of the double armed lever is pivotally connected at its free end to a release lever 128.

A blocking or second toggle lever, indicated generally at 131, is formed by the release lever 128 and a butt strap 130 pivotally connected to the release lever at the pivot axis 132 located at a point distant from the free end of the release lever 128. The other end of the butt strap 130 engages a tang 134 formed on the switching element 112. As can be readily seen from the drawings, the free end of the release lever overlaps the butt strap 130. It should be noted that the selector shaft 110 is located within the angle formed by the release lever 128 and the double armed lever 123, 126.

A control element 136, which is similar to the control element 54 of the previously described embodiment, interacts with the free end of the release lever, and in particular, a slanted surface 138 formed on the free end. The control element 136, pivotable about its longitudinal axis, is actuated through a butt strap 140 which in turn is connected to one end of a rod 142 secured at the other end to a core or armature 146 operatively associated with the electromagnet 116. The end of the rod 42 that engages the butt strap 140 passes through an elongated hole 144 formed on the housing. A resetting spring 148 urges the core 146 and the rod 142 to the position shown in FIGS. 8 and 10 when the electromagnet is not energized, or is energized at an undervoltage level.

When the switching element 121 is in its cut-in position, shown in FIG. 9, a spring 152 urges the leg 150 to rotate in a counter-clockwise direction. At the same time, a compression spring 154 urges the release lever 128, and hence the blocking lever 131, to the position shown in FIG. 9. It should be noted that the release lever 128 and the butt strap 130, which together constitute the blocking lever 131, are not in dead center alignment, but rather are slightly out of alignment by small bend angle $\alpha$. A set screw 155 threaded in the free end of the release lever 128 abuts the edge of the butt strap 130 near its lower end so that an adjustment of the set screw can cause a corresponding adjustment in the magnitude of the bend angle $\alpha$. The spring 154 holds the set screw 155 in this abutting or striking relationship while urging the release lever to rotate in a clockwise direction.

In a typical sequence of operations, beginning with the switch in the open position shown in FIG. 8, the lever legs 122 and 150 of the first toggle lever 114 form an acute angle and the double armed lever 123, 126 is rotated counterclockwise so that the free end of the release lever 128 is spaced from the control element 136. To manually close the switch, the selector shaft is rotated clockwise which causes a corresponding rotation of the double armed lever 123, 126. The rotation of the double armed lever in turn drives the switching element to its cut-in position (FIG. 9) through the action of the blocking lever 131. If there is a normal operating voltage across the switch, the movement of the switching element to the cut-in position closes the series contacts which energize the electromagnet 116 sufficiently to draw the core 146 and the members connected to the core 146 into the position shown in FIG. 9 against the action of the spring 148. In this situation, the control element is positioned so that its edge 160 is clear of the release lever 128 as it moves into its cut-in position. The switching element is locked or blocked in its cut-in position, provided the voltage is at its normal operating level, by the near dead center positioning of the blocking lever 131 and the first toggle lever 114. As shown in FIG. 9, with the switching element cut-in, the lever legs 150 and 122 are past their dead center position and off-set from alignment with one another by a small angle $\beta$. The blocking action of these toggle lever arrangements is sufficient to overcome the effect of a counter spring 121 that urges the switching element 112 towards its cutout position.

If an undervoltage condition should occur while the switch is closed, the electromagnet 116 does not exert a sufficient force on the core 146 to overcome the effect of the resetting spring 148. As a result, the core moves to the position shown in FIG. 10 causing the control element 136 to rotate in a clockwise direction to the position shown. This rotation of the control element causes its edge 160 to drive the release lever 128 in a counter-clockwise direction a sufficient distance to move the legs 128 and 130 forming the blocking lever 131 through their dead center position. The counter spring 121 then becomes the dominant force acting on the switching element 112 causing it to move quickly back to its cut-out position and causing the blocking lever 131 to assume the phantom position shown in FIG. 10. This movement of the blocking lever dissipates the spring force P (FIG. 10) generated by the compressed spring 121 that acts on the double armed lever 123, 126 through the blocking lever 131. With this force dissipated, the torsion spring 152 drives the first toggle lever 114 back to its initial, open switch position. If the switch is manually closed during an undervoltage condition, the slanted surface 138 of the release lever 128 strikes the edge 160 of the control element 136 causing a sufficient counter-clockwise movement of the release arm 128 to automatically open the switch in the manner described above.

Figure 11:
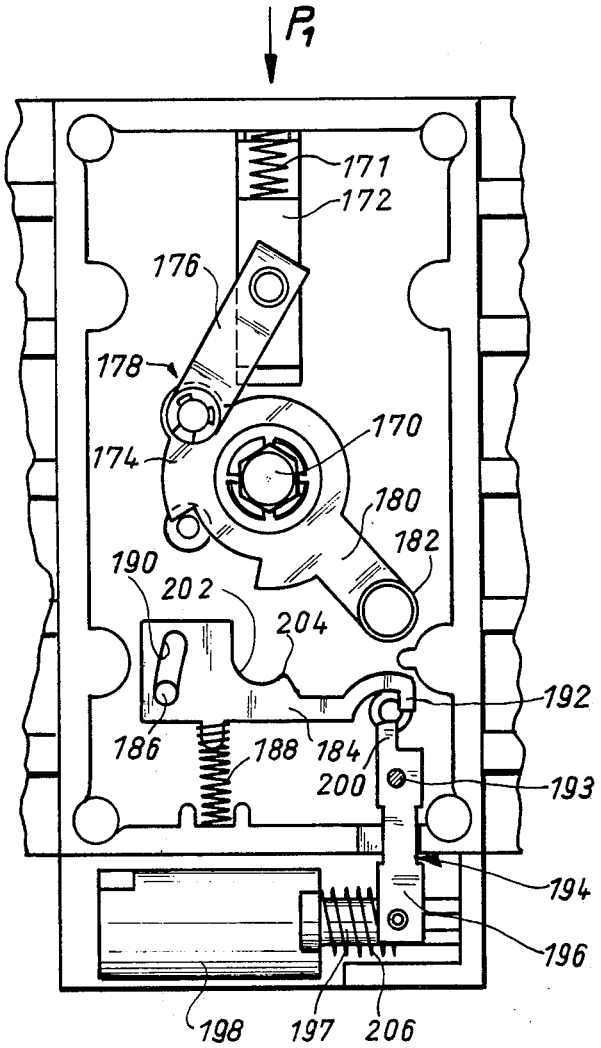
FIG. 11 is a view corresponding to FIGS. 4–6 and FIGS. 8–11 of another alternative embodiment of an undervoltage cut-off mechanism constructed according to the invention with the switch in an open condition.
Figure 12:
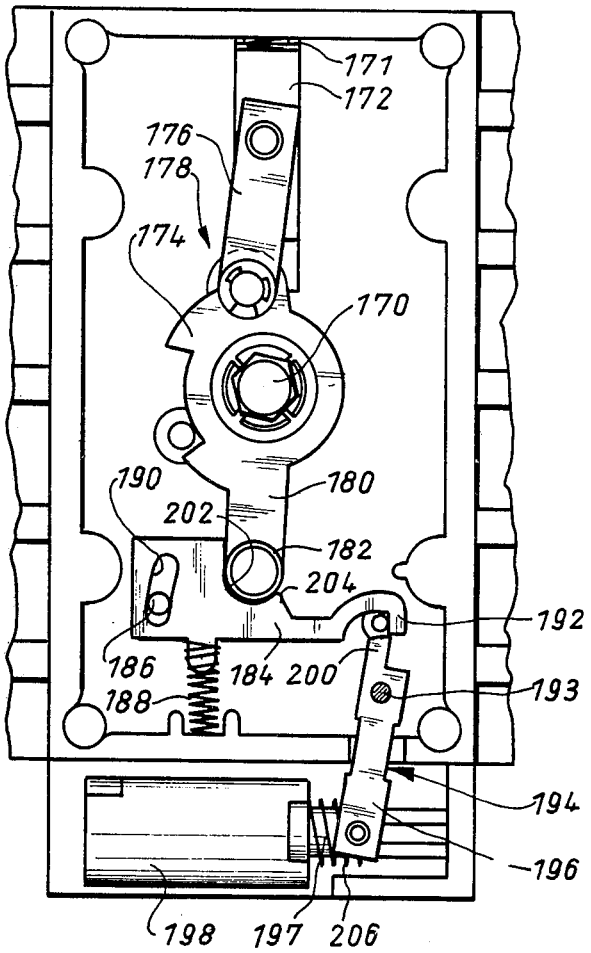
FIG. 12 is a view corresponding to FIG. 11 showing the switch in the closed condition with the voltage across the switch at the normal operating level.
Figure 13:
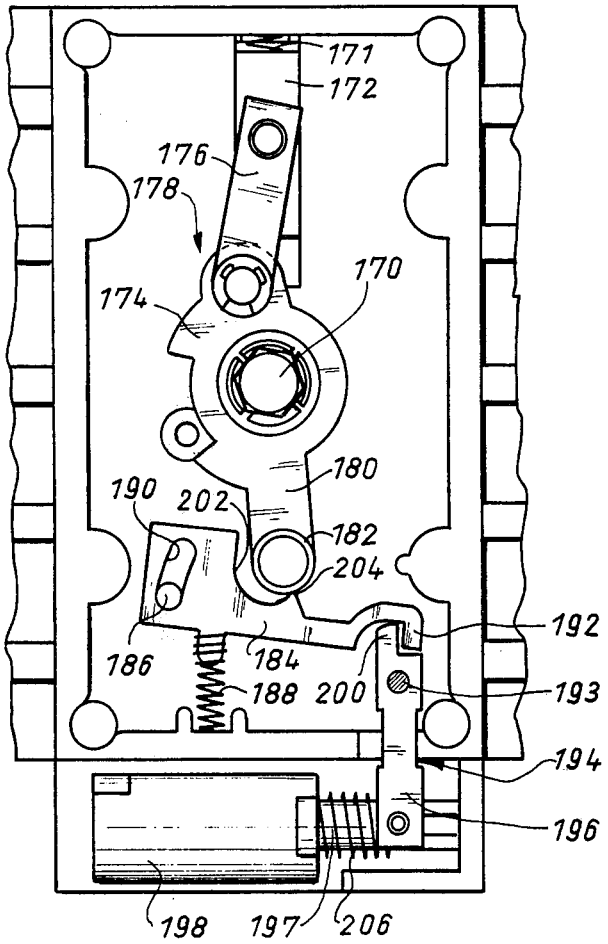
FIG. 13 is a view corresponding to FIGS. 11 and 12 showing the switch in the closed position but about to open due to an undervoltage condition.

FIGS. 11–13 illustrate another preferred embodiment of the invention. In this embodiment, a selector shaft 170, a switching element 172, a first toggle lever 178 operatively connecting the selector shaft and the switching element, and the cut-out mechanism are all accomodated in the same housing compartment. A double armed lever non-rotatably mounted on the selector shaft 170 has one lever arm 174 which is pivotally connected with a butt strap 176 to form a first toggle lever 178. The other arm 180 of the double armed lever acts as a blocking lever. At its free end, the lever arm 180 carries a roller 182 which interacts with a release lever 184 that is pivotable about a fixed pin 186 that rides in an elongated closed slot 190 formed in one end of the release lever 184. The pivot pin 186 is generally co-axial with the selector shaft 170 and the elongated slot 190 extends in a direction generally transverse to that of the longitudinal axis of the release lever.

The release lever 184 is also secured at its longitudinal edge opposite the lever arm 180 to a compression spring 188 that is oriented to urge the release arm to travel over the pin 186, along the slot 190 towards the selector shaft 170. At its other free end, the release lever has a lug 192 that engages a control element 194 in the form of a double armed lever pivotable about a fixed pin 193. The control element 194 has one arm 196 which is pivotably connected with the core or armature 197 operatively associated with an electromagnet 198. The other arm 200 of the control element 194 forms a counter-lug adapted to engage the lug 192 of the release lever.

The release lever 194 has a detent recess 202 formed on its edge facing the selector shaft 170 which receives and holds the roller 182 when the switch is in the closed position shown in FIG. 12. In moving from the open switch to the closed switch positions, the roller 182 rides over a catch lug 204 formed on the release lever 184 adjacent to the recess 202. As the roller passes over the catch lug 204 the release lever 184 deflects in a direction away from the selector shaft 170 against the action of the compression spring 188.

When the voltage across the switch is at the normal operating level, the electromagnet 198 is energized sufficiently to draw the core 197, against the force of the resetting spring 206, into the position shown in FIG. 12, with the end surfaces of the lugs 192 and 200 in the abutting relationship. In this position, the locking lever 180 is locked in the detent recess 202 because the force of the compression spring 188 and the force $P_1$ (FIG. 11) of the counter spring 171, as diminished by the effect of the first toggle lever 178 being close to dead center position, are such that the force $P_1$ is insufficient to overcome the contact friction between the release lever and the locking lever. In the event of an undervoltage condition, the resetting spring 206 pivots the control element to the position shown in FIG. 13 which causes the lugs 192 and 200 to move out of the abutting relationship and into the position shown in FIG. 13. This in turn releases the blocking lever 180 by allowing the roller 182 to move out of the recess 202 under the influence of the counter spring 171. The spring 171 continues to drive the switching element 172 towards its cut-out or open switch position until the switch element again resumes the position shown in FIG. 11. As with the previously described embodiments, if the switch is placed in the closed condition during an undervoltage condition, the cut-out mechanism will quickly move into the position shown in FIG. 13 and automatically reopen the switch.

Having thus described the preferred embodiments of the invention, what is claimed is:

1. An electric switch that automatically opens when the voltage carried by the switch falls below a predetermined value comprising, in combination, a switching element linearly movable along the direction of its longitudinal axis between a cut-in position that closes the switch and a cut-out position that opens the switch and is biased toward its cut-out position, control means having an electromagnet electrically connected in series with the switch, a release lever actuated by said control means to move from a first position to a second position when the voltage energizing said electromagnet falls below said predetermined value, a blocking mechanism operating with said release lever and said switching element to move from a blocking position in which it maintains the switching element in said cut-in position to a release position in which it allows said switching element to move to said cut-out position in response to said release lever moving from said first position to said second position, and a selector shaft and a first toggle lever acting independently of the blocking mechanism and operatively connecting said selector shaft and said switching element to drive said switching element between said cut-out and cut-in positions in response to a rotation of said selector shaft, said first toggle lever being near its dead center position when said switching element is in its cut-in position.

2. A switch according to claim 1 in which the one lever arm of the toggle lever is rotationally fixed on the selector shaft.

3. A switch according to claim 1 in which the blocking mechanism functions independently of the toggle lever and interacts either with the selector shaft or with the switching element.

4. A switch according to claim 1 in which the blocking mechanism comprises a pivotable blocking lever to block and release the switching elements, said blocking lever being held in its blocking position by the said release lever when the electromagnet is energized by a voltage at or above said predetermined value.

5. A switch according to claim 4 wherein said control means has a core, a movable control element, and means operatively connecting said control element and said core, said movable control engaging said release lever and being structured to maintain said release lever in said first position when the voltage is at or above said predetermined voltage and to place said release lever in said second position when the voltage is below said predetermined level.

6. A switch according to claim 5 wherein said core is drawn towards said electromagnet when said electromagnet is energized, and further comprising a resetting spring that urges said core in a direction opposite to said electromagnet, said spring being structured to move said core in said opposite direction when the electromagnet is energized by a voltage below said predetermined level.

7. A switch according to claim 4 in which the blocking lever of said blocking mechanism is a second toggle lever movable between its blocking and release positions through its dead center position.

8. A switch according to claim 4 further comprising a movable control element wherein said blocking lever is pivotally mounted on the selector shaft and can be locked in a detent recess of the release lever, said release lever is mounted to pivot between said first and second position about a pivot pin, and said detent recess is located between the pivot pin of the release lever and a free end which interacts with the movable control element.

9. A switch according to claim 8 further comprising a spring acting on said release lever and wherein the release lever is mounted on the pivot pin so that it is radially adjustable under the action of a compression spring to allow a manual opening and closing of the switch.

10. A switch according to claim 8 in which the release is located between the selector shaft and the electromagnet.

11. A switch according to claim 8 wherein said control means further comprises a core acted upon by the electromagnet and in which the release lever is constructed as a single arm and the movable control element is a double-armed control lever, one lever arm of said control lever being pivoted at the core of the electromagnet and the other free lever arm being located below the free end of the release lever.

12. A switch according to claim 11 wherein said free ends of said release lever and said control lever are structured so that the free end of the release lever is directed toward the control lever and moves from an abutting to an adjacent relationship when said control lever moves in response to an undervoltage condition.

13. A switch according to claim 8 wherein said first toggle lever has a first lever arm mounted on said selector shaft, said first lever arm being one arm of a double armed lever with said blocking lever being the other arm.

* * * * *